US006863532B1

(12) United States Patent
Ambrosoli

(10) Patent No.: US 6,863,532 B1
(45) Date of Patent: Mar. 8, 2005

(54) EQUIPMENT FOR DETECTING THAT A TARGET HAS RECEIVED A DIRECT HIT FROM A SIMULATED WEAPON

(75) Inventor: Franco Ambrosoli, Novara (IT)

(73) Assignee: Ambrosoli Franco, Novara (IT)

( * ) Notice: Subject to any disclaimer, the term of this patent is extended or adjusted under 35 U.S.C. 154(b) by 0 days.

(21) Appl. No.: 09/914,143

(22) PCT Filed: Mar. 8, 1999

(86) PCT No.: PCT/EP00/02045

§ 371 (c)(1),
(2), (4) Date: Aug. 23, 2001

(87) PCT Pub. No.: WO00/53996

PCT Pub. Date: Sep. 14, 2000

(30) Foreign Application Priority Data

Mar. 10, 1999 (IT) ..... MI99A0484

(51) Int. Cl.[7] ..... F41A 33/00

(52) U.S. Cl. ..... 434/11; 434/16; 434/17; 434/19; 434/21; 434/22; 463/2; 463/51; 463/53; 463/52

(58) Field of Search ..... 434/11, 15–23; 463/2, 49–57

(56) References Cited

U.S. PATENT DOCUMENTS 3,950,862 A * 4/1976 Schiel et al. ..... 434/22
4,086,711 A * 5/1978 Gammarino et al. ..... 434/22
4,299,393 A * 11/1981 Benckert et al. ..... 463/51
4,487,583 A 12/1984 Brucker et al.
4,653,760 A * 3/1987 Dyer et al. ..... 463/51
4,899,039 A 2/1990 Taylor et al.
5,194,007 A * 3/1993 Marshall et al. ..... 434/21
5,344,320 A 9/1994 Inbar et al.
5,577,962 A * 11/1996 Kounoe et al. ..... 463/49
5,738,522 A * 4/1998 Sussholz et al. ..... 434/22
5,788,500 A * 8/1998 Gerber ..... 434/22
6,302,796 B1 * 10/2001 Lebensfeld et al. ..... 463/51

FOREIGN PATENT DOCUMENTS

GB 2259559 A * 3/1993 ..... F41A/33/02
WO WO 99/09368 2/1999

OTHER PUBLICATIONS

Newton, Harry. Newton's Telecom Dictionary, 1998,Flatiron Publishing, pp. 610–611.*

* cited by examiner

*Primary Examiner*—Joe H. Cheng
*Assistant Examiner*—Cameron Saadat

(57) ABSTRACT

Equipment for detecting that a target has received a direct hit from a simulated weapon including a weapon (10, 30) and a target (11, 12, 38, 45), and characterized in that said weapon (10, 30) provides an emitter of signals or laser shots (14, 33) operated by a switch (16, 35) and a trigger (18, 36), and in that said target includes sensors (**19, 20, 38*a*, 41–44) affixed to a supporting element (12, 11, 38, 45**). Said sensors are operatively connected to an electronic detection circuit for a signal or laser shot received by the same sensors.

6 Claims, 3 Drawing Sheets

Fig.4
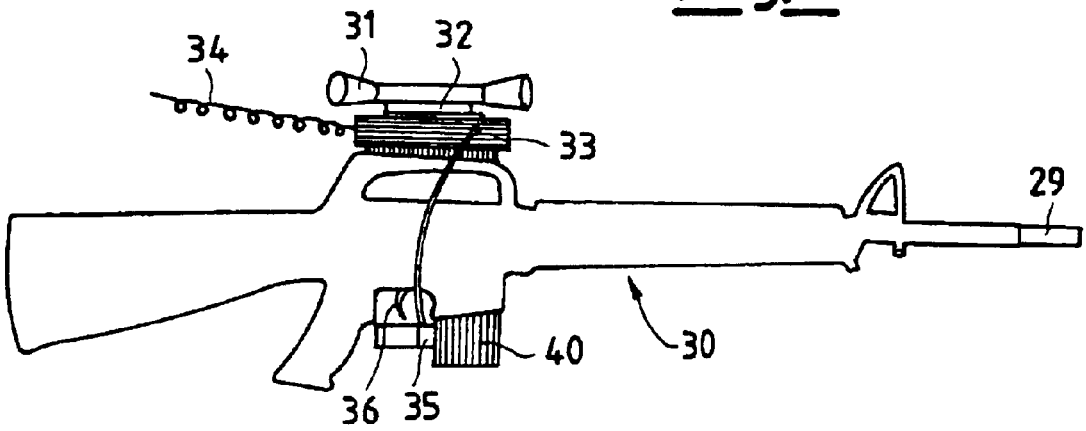
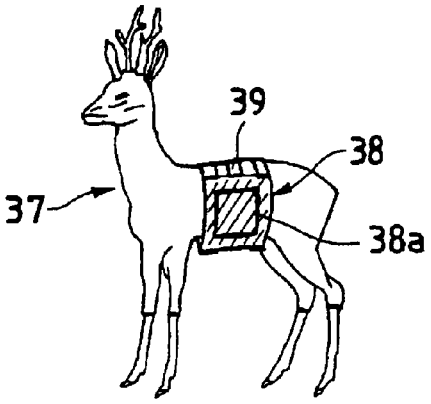
Fig.5
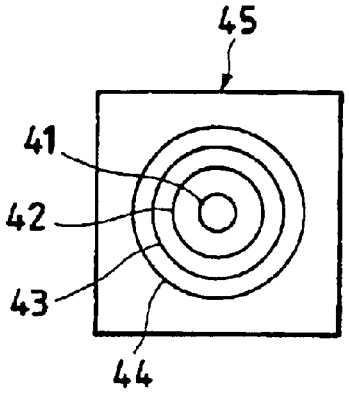
Fig.6

EQUIPMENT FOR DETECTING THAT A TARGET HAS RECEIVED A DIRECT HIT FROM A SIMULATED WEAPON

BACKGROUND OF THE INVENTION

The present invention refers to equipment for detecting that a target has received a direct hit from a simulated weapon.

In the field of harmless weapons which, in turn, can be divided into toy war guns, hunting firearms and rifle range weapons, there are the so-called electric, gas, spring-loaded and compressed air types.

Electric weapons are powered by an electric motor which drives three gears in turn acting on a piston. Power supply is through a rechargeable battery. Gas weapons are powered by gas from a cylinder, spring-loaded weapons function thanks to a loaded spring ejecting the projectile. Lastly the compressed air types are powered by compressed $CO_2$.

In general, all these weapons fire a projectile consisting of a 6 mm calibre plastic pellet. In addition, other projectile types exist, comprising of measured amounts of dye which strikes the target, thus confirming a direct hit thereof. However all of these require that the weapon, whatever type, must shoot a projectile which could potentially endanger users.

In addition, the part which is hit by the dye must be replaced or cleaned thus causing certain drawbacks.

SUMMARY OF THE INVENTION

Furthermore, with plastic projectiles, it is not always possible to ascertain with certainty, whether or not the target has been hit. The general object of the present invention is to solve the abovementioned problem associated with the state of the art in an extremely simple, low-cost and highly practical manner.

Another object is to eliminate any chance of danger and avoid the need to replace or clean target parts which have been hit.

Another object is to assert that the shot has hit the target.

WO-A-99/10700 relates to a firearm target system including a training firearm that emits laser signal in response to a mechanical wave generated from pulling the trigger of the firearm.

EP-A-0 232 157 refers to an equipment for detecting that a target has received a direct hit from a simulated weapon according to the preamble of claim 1.

U.S. Pat. No. 4,487,583 describes a receiver garment for weapons engagement simulation system, wherein said garment carries a plurality of photosensitive detectors.

U.S. Pat. No. 5,344,320 discloses a dual mode apparatus for assisting in the aiming of a firearm including laser apparatus.

BRIEF DESCRIPTION OF THE DRAWINGS

In view of the abovementioned objects, according to the present invention, it was decided to design equipment for detecting that a target has received a direct hit from a simulated weapon, possessing the features explained in greater detail in the enclosed claims. The design and practical features of the present invention, and its advantages compared to the known technique, will be made even clearer and apparent by the following description, referring to the enclosed drawings, which illustrate examples of equipment made according to the invention. In the drawings:

FIG. 4 shows a rifle constituting the first part of equipment used in the second embodiment of the invention;

FIG. 5 shows the second part of equipment applied to an animal for use with the rifle in FIG. 4;

FIG. 6 shows a rifle range target equipped with sensors according to the invention;

DETAILED DESCRIPTION OF THE INVENTION

With reference to the Figures, equipment is proposed for detecting that a target has received a direct hit from a simulated weapon.

Figure 1:
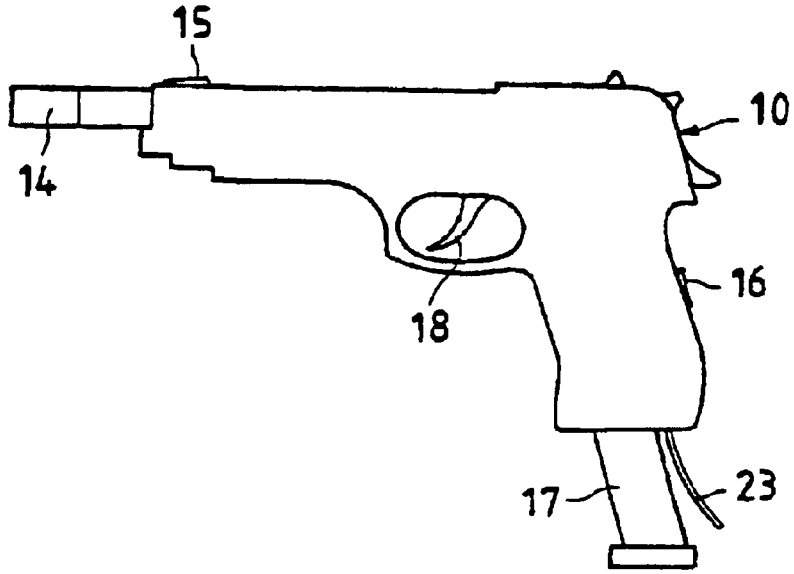
FIG. 1 shows a pistol constituting the first part of equipment used in an embodiment of the invention.
Figure 2:
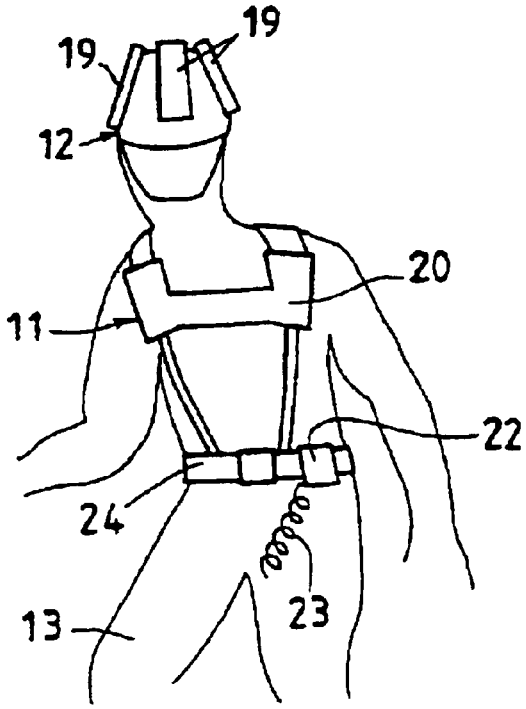
FIG. 2 shows a second part of equipment applied to the front of a person for use with the pistol in FIG. 1.
Figure 3:
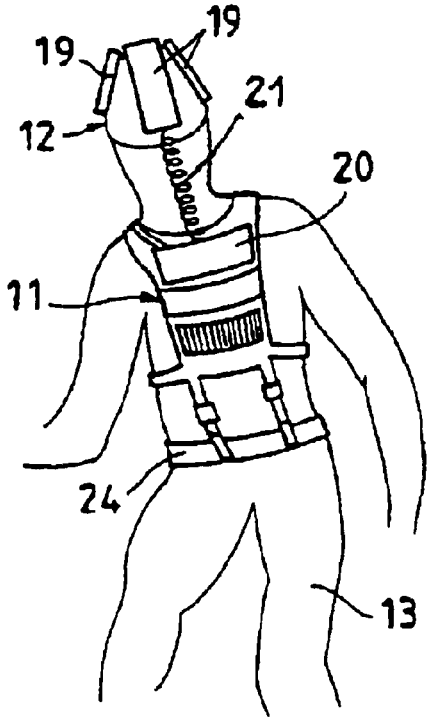
FIG. 3 shows the second part of equipment applied to the rear of a person for use with the pistol in FIG. 1.

FIGS. 1–3 show a first embodiment in which the equipment consists of a firearm, namely a pistol 10 and a target, namely a jacket 11 and a helmet 12 worn by an individual 13.

The pistol 10 has a coded laser emitter 14 situated on the pistol barrel, connected to a switch 15 for its activation and another switch 16 situated on the pistol handle.

A magazine 17, upon insertion into the pistol 10, turns on switch 16 on the handle. A trigger 18, when pulled, fires the pistol, brought about by the laser emitter 14.

The individual 13 carries a circuit box 22 attached to a belt 24 which is connected, by wire 23, to the pistol 10, the same wire 23 enters the underside of the handle. In addition, the jacket 11 and helmet 12 are fitted with sensors 19 and 20 interconnected by another wire 21, situated on the back of the individual 13.

The circuit box 22 also contains a battery and an acoustic signaller.

FIGS. 4 and 5 show a second embodiment of the invention equipment, in which a rifle 30 is used as the weapon, containing a laser emitter 29. The rifle 30 is fitted with sights 31 on a slide 32, in turn located on a control box 33, containing the laser control electronic circuit, in turn, positioned on an additional slide. The box 33 and the relative circuit are connected, by a wire 34, to a battery pack, not shown, carried by the individual user. Only the circuit box 33 could also be carried by the user.

The rifle 30 also has a switch 35 which activates a trigger 36 of the laser emitter. A magazine 40 may be inserted into the rifle 30 near the trigger. An animal 37, for example a deer, is covered with a vest or jacket 38 fitted with sensors 38*a* and a box 39 which contains a receiving circuit.

In the two examples shown, the receiving unit is positioned differently which is positioned respectively in the first instance (FIGS. 1–3) in box 22 and in the second instance (FIGS. 4–5) in box 39 which sends it to a computer (not shown), possibly connected in turn to the person with the rifle 30, so as to allow the detection of a direct hit or not.

A similar arrangement to the second is that which may also be used in rifle range equipment which envisages a fixed target 45 (FIG. 6) and a weapon used by the shooter, namely those shown in FIGS. 1 and 4, both connected to a computer and supplied with signalling devices.

The target 45 may contain sensors 41, 42, 43, 44) at the various zones marked by concentric rings. Naturally, real weapons may also be used with blank rounds or plastic pellets.

Figure 7:
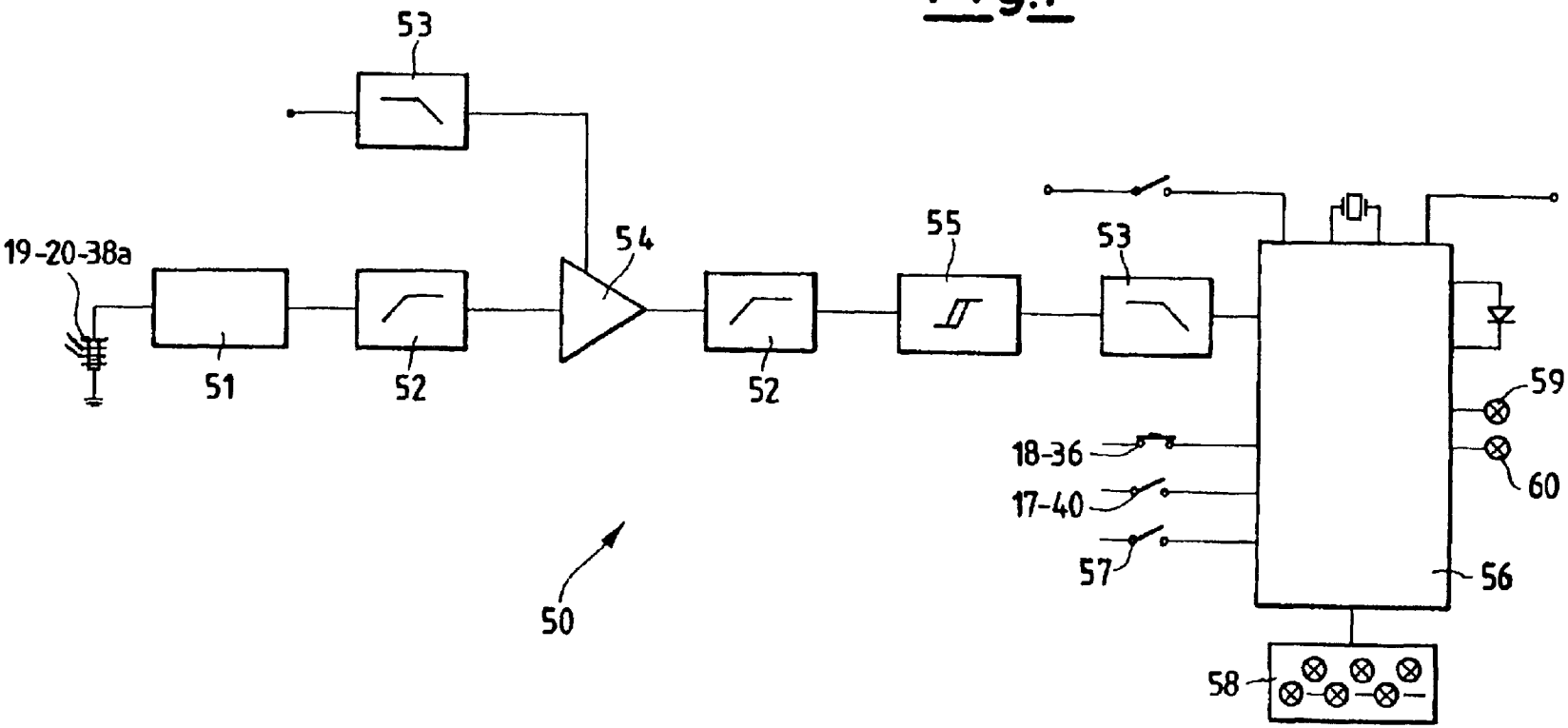
FIG. 7 shows a controller to be used with equipment of the abovementioned type.

As regards the production of a device or electronic control circuit of the equipment, FIG. 7 shows one possible example by way of a block diagram denoted, as a whole, by 50.

The device 50 is built around an RISC technology microcontroller (56), which performs the vast majority of the functions required by the specific application.

Power supply is provided by a pack of four 1.5 V batteries, or five rechargeable 1.2 V batteries. Note that the maximum electrical input when firing volleys is 83 mA, whereas it is 7.7 mA with weapon 10 or 30 at rest with a backup magazine 17 or 40 in the barrel. Such values permit a battery operating range with 500 mA/h batteries of between six to eleven hours of activity considering weapon usage of respectively 100% and 50% of the activity time. Obviously batteries with greater capacities will result in proportionately increased operating ranges.

The sensors 19, 20, and 38*a* of hit detection are, according to the invention, made of solar cells. Preference for these solar cells over ordinary photocells has allowed a reduction in sensor thickness which are fitted in the "bulletproof vest" 11, on the helmet 12 or the vest 38.

The solar cell responds, without any attenuation, to incident beams even with angulations well outside what is normal to the plane of the same sensors. More expensive new generation solar cells, which are readily available on the market and made from flexible materials, make the sensors less sensitive to knocks.

To increase the reaction to random light signals common to all solar units, the same units could be counter-series connected. This greatly decreases the reduction in reception sensitivity caused by electrical discharge light sources, namely neon and mercury-discharge lamps. To curb this effect, a red film (not shown) is applied to the surface of the sensor and acts as an optic filter which cuts out the emissions in the upper band of the luminous spectrum.

Such an arrangement solves the problem connected with the use of photocells which would have required the use of lenticular optic units, with a focus of no less than 5 cm, to cover the discrete areas of detection.

Besides, the presence and use of optic collimation units of the light bands would have made the reception system directive.

In support of the microcontroller 56 for that concerning the processing of the signal detected by the optic sensors 19, 20, 38*a* an amplification and filtering chain has been included to eliminate random components from the optic signal and to bring the signal to a level which is compatible with the same microcontroller.

The sensor signal passes into an attenuator circuit 51 which, by raising the input impedance, acts as a limiter for input into a subsequent amplifier 54 which is integrated upstream and downstream by high-pass filters 52. Due to the high gain of the input amplifier 54, a low-pass filter 53 is placed on the power supply to lessen and make insignificant any sound produced by the microcontroller 56.

The output of the amplifier 54 is clipped and made compatible with the microcontroller 56 by a Schmitt trigger 55 which, with a 1% opening of the input voltage, removes any possible background noise from the signal. A following additional low-pass filter 53 removes all the possible high frequency components which could interfere with the functioning of the microcontroller 56.

The microcontroller 56 picks up the signal coming from the sensors 19, 20 and 38*a* and emits a message based on the decoded signal.

In fact, there is an indicator 59 of a player's "death", for example a flashing red light. Another signal 60 indicates if the weapon is unloaded and another signaller 58 shows the presence of magazines in a weapon that is activated.

When the magazine 17, 40 is released or the signaller 59, indicating the player's "death", is activated the microcontroller 56 makes it impossible for any further shots to be fired.

The shot is represented by a coded signal lasting approximately 50 m/s which can be emitted singly or repeatedly, at a rate of ten signals per second, depending on a manual or automatic weapon dial 57 (repeater shots or machine gun). The emitted shot signal controls a laser diode with radiation at the lower end of the frequency spectrum making up visible light (red colour at 670 nm; max. power 5 mW).

When the magazine 17, 40 in the barrel runs out of shots, the microcontroller 56 prevents their emission and activates a signaller 60 which flashes green for an eighth of a second every second.

To replace the magazine 17, 40 it must be disconnected from the weapon 10, 30 until the flashing green signaller 60 stops flashing.

In addition, the microcontroller 56 emits two signals for a generator of sound effects which reproduces differentiated sounds for when shots are fired and when a player is hit. Quartz was appropriately chosen as the base time reference of microcontroller 56, since the coding signals emitted (shots) and the decoding system of the signals received do not require any setting procedure.

To use the first weapon 10 with individuals equipped with jacket 11 and helmet 12, the users 13 must wear mirrored protective glasses to avoid the laser emission striking the pupils. This would cause irreparable damage to the retina.

The shot is a single modulated laser emission so as to avoid the random effect of external light sources.

The object mentioned in the preamble of the description is thus achieved in this way.

The invention is likewise applicable to real weapons loaded with blank rounds, where two adversaries fight each other, or in hunting which, with the use of the system according to the invention, could be called "fair hunting" since it is indeed without bloodshed.

It would be sufficient to fit the chosen animal with a solar cell.

The scope of protection of the invention is therefore defined by the claims enclosed.

What is claimed is:

1. Equipment for detecting a direct hit on a target by a signal from a simulated weapon in a system comprising a weapon (10, 30) and a target (11, 12, 38, 45), wherein:

said weapon (10, 30) comprises a signal emitter (14, 33) operated by a switch (16, 35) and a trigger (18, 36);

said target consisting essentially of flexible solar cells (19, 20, 38*a*, 41–44) affixed to a supporting element (12, 11, 38, 45), said flexible solar cells (19, 20, 38*a*, 41–44) provided with a red film, said flexible solar cells being operatively connected to an electronic detection circuit for detecting a signal or laser shot received by said flexible solar cells, said supporting elements being worn by a targeted individual, said signal emitter being associated with a barrel of a pistol (10) or a rifle (30) or emitting said signal or laser shot;

said equipment further comprising a control device (50) wherein:

said control device comprises a RISC microcontroller (56) with a power supply;

said control device including a direct hit indicator (59), and a flashing green signaler (60) for indicating whether said weapon is unloaded, and a magazine signaler (58) for detecting if magazines (17, 40) in said weapon are connected to said microcontroller (56), wherein said microcontroller (56) prevents said weapon from being fired when said hit indicator (59) is on;

wherein said microcontroller (56), further comprises an amplification and filtering chain to eliminate random components from said signal and to make said signal compatible with said microcontroller (56), wherein said chain comprises an attenuator circuit (51) fitted upstream from an amplifier (54), which is integrated upstream and downstream from high-pass filters (52), further comprising a low-pass filter (53) on a power supply, wherein an output of said amplifier (54) is attached to said microcontroller (56) by a Schmitt trigger (55) possessing a 1% opening of a voltage which allows an additional low-pass filter (53) to remove all possible high frequency components which could interfere with functioning of said microcontroller (56).

2. Equipment according to claim 1, wherein said supporting elements are a jacket (11) and a helmet (12).

3. Equipment according to claim 1, wherein said supporting element is a target.

4. Equipment according to claim 1, wherein said weapon is a pistol (10).

5. Equipment according to claim 1, wherein said weapon is a rifle (30).

6. Equipment according to claim 1, wherein said microcontroller (56) is connected to a generator of differentiated sound effects.

* * * * *

UNITED STATES PATENT AND TRADEMARK OFFICE

CERTIFICATE OF CORRECTION

PATENT NO. : 6,863,532 B1
DATED : March 8, 2005
INVENTOR(S) : Franco Ambrosoli et al.

It is certified that error appears in the above-identified patent and that said Letters Patent is hereby corrected as shown below:

Title page,
Item [75], Inventor, add the second inventor's name -- Massimo Porzio --
Item [22], PCT Filed, should read -- March 8, 2000 --

Signed and Sealed this

Twenty-eighth Day of June, 2005

JON W. DUDAS
*Director of the United States Patent and Trademark Office*